US005191712A

United States Patent [19]

Crook et al.

[11] Patent Number: 5,191,712

[45] Date of Patent: Mar. 9, 1993

[54] SAFETY RAZORS AND GUARDS

[75] Inventors: Alan Crook, Basingstoke; Oliver D. Oglesby, Tadley; Brian Oldroyd, Reading, all of England

[73] Assignee: The Gillette Company, Boston, Mass.

[21] Appl. No.: 943,993

[22] Filed: Sep. 11, 1992

Related U.S. Application Data

[63] Continuation of Ser. No. 659,430, May 16, 1991, abandoned.

[30] Foreign Application Priority Data

Oct. 28, 1988 [GB] United Kingdom ..... 8825268

[51] Int. Cl.[5] ..... B26B 19/42

[52] U.S. Cl. ..... 30/34.2; 30/34.05; 30/77

[58] Field of Search ..... 30/34.2, 32, 34.05, 30/47-50, 77

[56] References Cited

U.S. PATENT DOCUMENTS

| | | | |
|---|---|---|---|
| 2,068,085 | 1/1937 | Stanley . | |
| 3,138,865 | 6/1964 | Meyer . | |
| 3,909,939 | 10/1975 | Dootson et al. | 30/34.2 |
| 4,189,832 | 2/1980 | Harper et al. | 30/34.2 |
| 4,310,968 | 1/1982 | Buik et al. | 30/34.2 |
| 4,741,103 | 5/1988 | Lambert | 30/34.2 |

FOREIGN PATENT DOCUMENTS

| | | |
|---|---|---|
| 0254491 | 1/1988 | European Pat. Off. . |
| 2323502 | 4/1977 | France . |

*Primary Examiner*—Douglas D. Watts
*Attorney, Agent, or Firm*—Charles P. Boukus, Jr.

[57] ABSTRACT

A razor head or cartridge is provided on its skin engaging surfaces, e.g. caps and/or guard surfaces with an array of closely spaced projections which, in use, produce a pleasant tactile sensation tending to reduce shaving discomfort.

The projections may be formed by closely packed flexible filaments, or by moulded fins or pillars.

13 Claims, 3 Drawing Sheets

Figure 2:
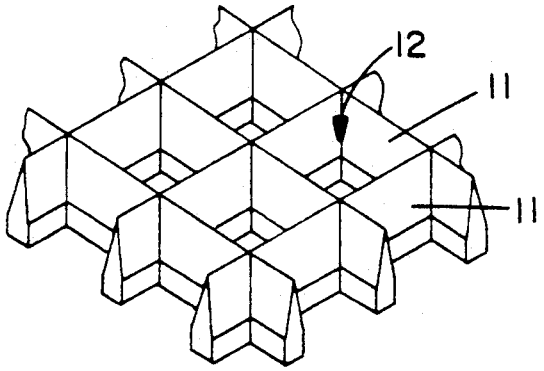

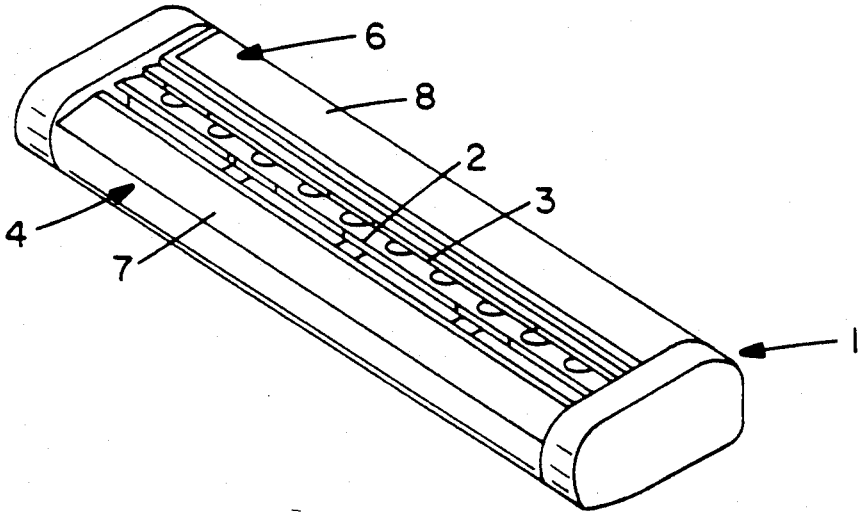
FIG. 1
FIG. 8
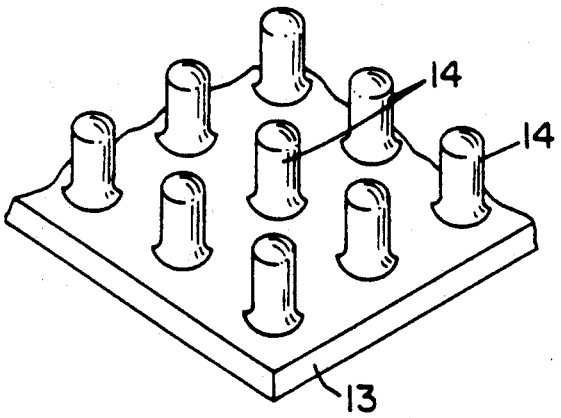

SAFETY RAZORS AND GUARDS

This is a continuation of co-pending application Ser. No. 07/659,430 filed on May 16, 1991, now abandoned.

This invention relates to razors having one or more blades and skin engaging surfaces arranged ahead of and/or behind the blade edge or edges.

The invention is applicable to razors of various forms, such as so-called 3-piece razors, one-piece, or disposable razors and to razors in which the head is formed by a replaceable blade cartridge.

In conventional razors, the skin engaging surfaces are formed as cap and guard members, the cap member being positioned behind the blade edges(s) and the guard member ahead of the edge(s).

The present invention resides broadly in providing the skin engaging cap and/or guard surfaces with configurations or textures designed to promote pleasant tactile sensations, in use of the razors, which tend to mask the sensations caused by contact of the blade edge(s) with the skin and more significantly with the facial hairs as they are severed.

It is known that small discrete regions of the skin, approximately 1 mm across on the face, are served by separate nerve networks so that it is not possible subjectively to distinguish between two separate points of pressure applied to the skin less than about 1 mm apart. These areas can be stimulated repeatedly by a succession of pressure points moving across them. By controlling the pressure to a low but adequate level it can be assured that the sensation is pleasant, but it has been found, surprisingly, that this raises the threshold stimulus level for discomfort.

In the embodiments of the invention described below, the skin engaging surfaces of the razor head or cartridge are provided in one form or another with projections whose function is to provide frequent stimulation of the individual nerve zones at a low but adequate pressure level. The pressures are controlled by making the projections flexible and by varying their density to achieve sufficient but not excessive stimuli.

The present invention provides a safety razor having one or more blades and a skin engaging surface (such as a cap member or a guard member) wherein the said surface is formed by a plurality of upstanding straight filaments present at a density of at least 100 per sq. mm, the filaments having a uniform length of 0.3 to 2.00 mm and diameters in the range of $(1.5 \text{ to } 3.2)\times 10^{-2}$ mm.

The invention also provides a safety razor having a skin engaging surface (such as a cap member or a guard member), wherein the said surface is composed of an array of projections comprising a plurality of rows extending generally parallel with the blade edge(s), the said projections being flexible under normal shaving forces in directions transverse to the blade edge(s), and wherein the said projections have a height in the range of 0.5 to 2.5 mm, a ratio of height to base thickness in the range of 2:1 to 5:1 and a spacing between adjacent longitudinal rows of 0.3 to 1.5 mm.

Some embodiments of the invention will now be described in detail, by way of example, with reference to the accompanying drawings, in which:

FIG. 1 is a perspective view of a conventional form of replaceable razor cartridge to which the invention may be applied;

FIGS. 2 to 8 each comprise a fragmentary view, on a greatly enlarged scale, of a skin engaging surface in accordance with the invention.

A cartridge of conventional form is illustrated in FIG. 1, which is a perspective view illustrating a cartridge body 1 of moulded construction (usually composed of a number of individual mouldings) in which are permanently secured a pair of blades 2, 3 whose cutting edges are disposed to act in tandem upon the skin. The body is formed to provide a guard member 4 and a cap member 6 having skin engaging surfaces 7 and 8, respectively, to engage the skin ahead of and behind the blade edges.

In accordance with the invention, one or both of the surfaces 7 and 8 is or are provided with a configured surface essentially comprising a plurality of spaced projections.

All linear dimensions specified herein are in mm.

In one embodiment of the invention, the surfaces are formed by spray flock coatings, e.g. of nylon, acetate or acrylic filaments having lengths of 0.3 to 2.00, and diameters of $(1.5 \text{ to } 3.2)\times 10^{-2}$. The filaments are applied at a density of 100 to 500 per sq. mm. The filaments may be disposed perpendicular to the skin engaging surface in question, or may be inclined up to 60° from the perpendicular, either forwardly or rearwardly relative to the shaving direction, and they may be orientated differently in different regions of the skin engaging surfaces.

Examples of various possible forms of moulded configurations are illustrated in FIGS. 2 to 8, respectively.

Figure 3:
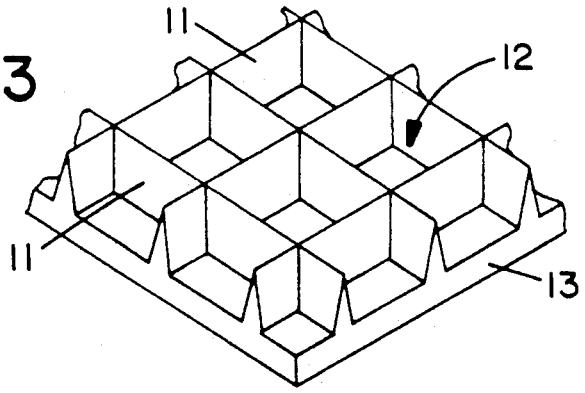

In FIG. 2, the surface is formed with a square grid pattern of mutually transverse walls 11, each tapering to a very thin edge. Each square cell 12 thus formed may be some 0.3 to 1.0 across, with its walls 0.5 to 2.5 high and with an "aspect ratio" of height to thickness of base in the range of 2:1 to 5:1. The structure may be completely open, as shown in FIG. 2 or, as illustrated in FIG. 3, it may have a continuous base 13.

Figure 4:
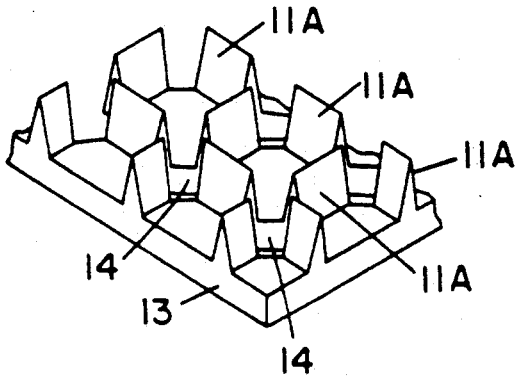

In FIG. 4, the individual projections 11A are spaced apart in respective, mutually transverse rows to form rectangular cells open at their corners and the base 13 has apertures 14 at the intersection of each group of four adjacent projections to facilitate clearance of shaving debris.

Figure 5:
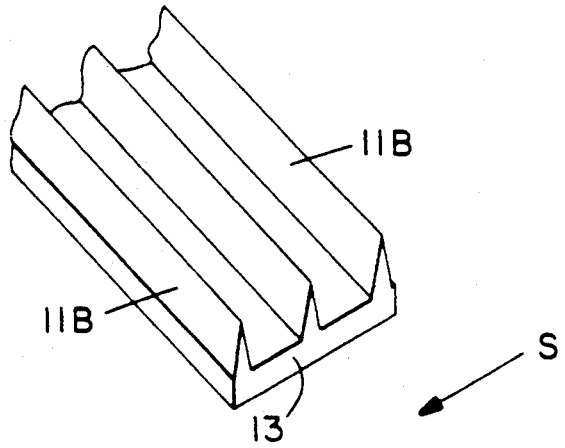
Figure 6:
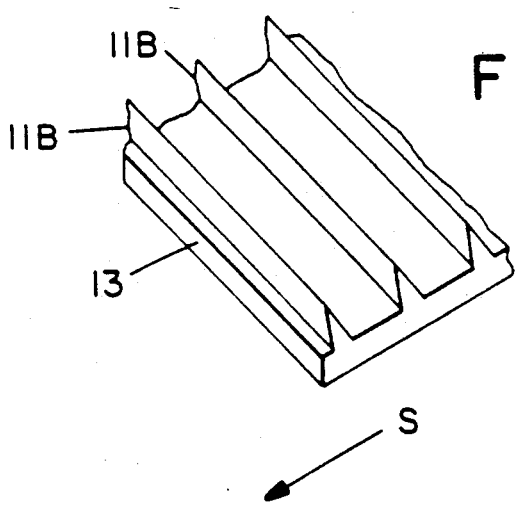

In FIGS. 5 and 6, the corresponding projections are formed as continuous longitudinal fins 11B. The fins may be spaced apart by 0.3 to 1.0, with a height of 0.5 to 2.5 and an aspect ratio in the range 2:1 to 5:1.

In FIG. 5 the fins are perpendicular to the base 13 but in FIG. 6 they are shown inclined at an angle of about 30° or more to the perpendicular, and forwardly relative to the shaving direction, indicated by the arrow 'S'.

The fins may alternatively be set to slope rearwardly relative to shaving direction at an angle of up to 30° beyond the perpendicular.

Figure 7:
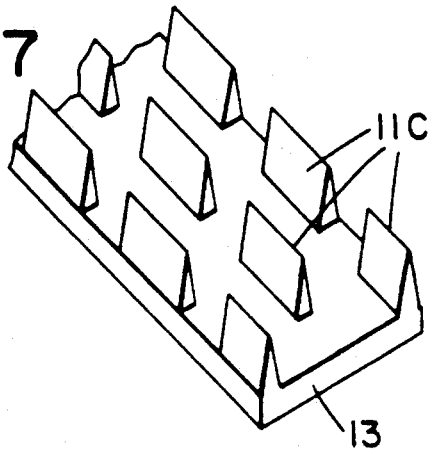
Figure 2:
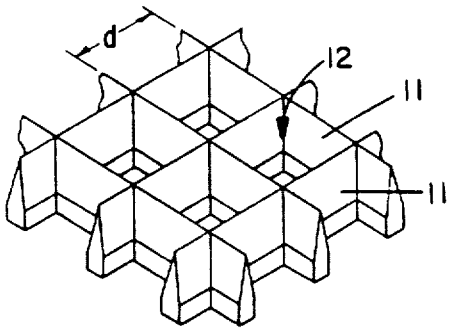
Figure 3:
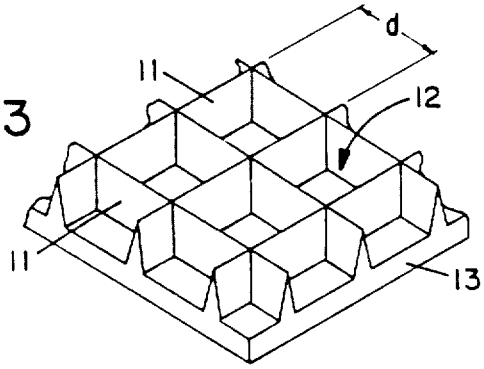
Figure 4:
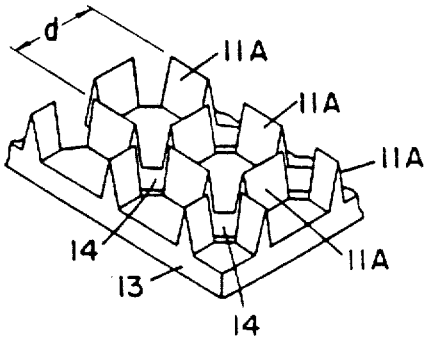
Figure 5:
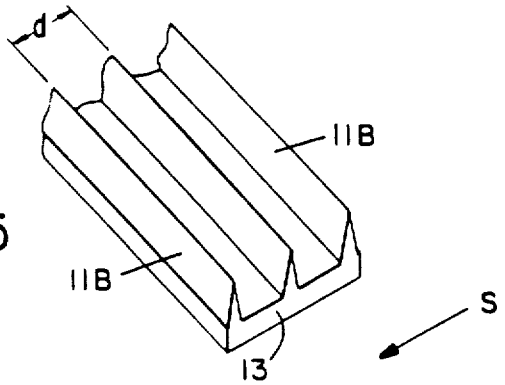
Figure 6:
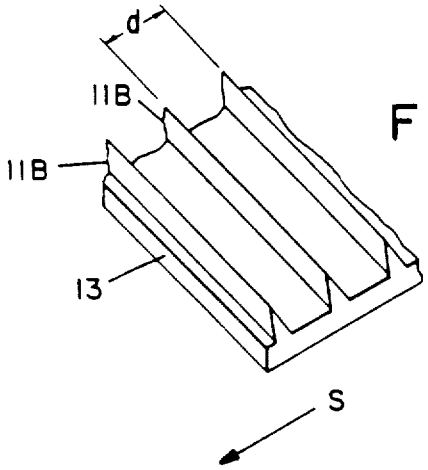
Figure 7:
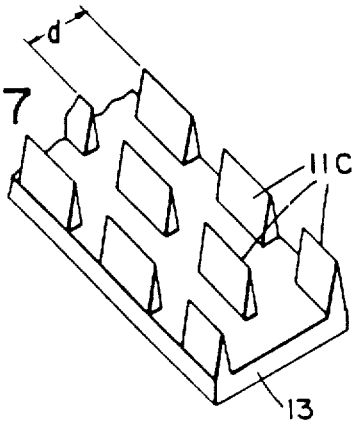

FIG. 7 illustrates a variant of FIG. 5 in which the fins 11C, instead of being continuous, are interrupted at intervals along their lengths. They may also be inclined, either forwardly or rearwardly, as described in relation to FIG. 6.

The action of the above described fins is as follows. Those arranged parallel to the blade edges interact with the skin either directly or through contact with facial hair to produce pleasant masking sensations, while those arranged perpendicular to the edges help to control the pressure of the parallel fins on the skin.

In each of the cases illustrated in FIGS. 2 to 7, the skin engaging surfaces are formed by mouldings of synthetic elastomeric materials. They may be formed integrally with the basic cap or guard structures, or as separate mouldings which are then attached to underlying cap and guard structures. This latter approach lends itself particularly well, but not exclusively, to incorporation in razor cartridges of the conventional form currently marketed widely in the UK and elsewhere.

FIG. 8 illustrates another form of the invention in which the skin engaging surfaces are formed with individual pillars 14. The pillars may have a height in the range of 0.5 to 2.5 with an aspect ratio of height to base diameter of 2:1 to 5:1 and with a spacing d between adjacent pillars in each row and between adjacent rows of pillars of 0.6 to 1.5. The base 13 and pillars 14 may be integrally moulded in one material which is relatively flexible, or the pillars might be made of a more rigid material set in an elastomeric base 13 which permits flexure of the individual pillars about their lower ends.

With all of the above described moulded constructions, the precise arrangement and dimensioning of the fins, walls, pillars or other projections will be dependent in part on the flexibility of the particular materials selected, which will normally have a hardness of less than 90 Shore A.

It will also be possible to combine different surfaces on different regions of the razor, say one type on the cap member and another on the guard member as well as to combine different surfaces on different regions of either member.

We claim:

1. A safety razor having one or more blades and a skin engaging surface wherein said surface is formed by a plurality of upstanding straight filaments said filaments extending throughout their length away from said surface, said filaments present at a density of at least 100 per sq. mm, the filaments having a uniform length of 0.3 to 2.00 mm and diameters in the range of (1.5 to 3.2)$\times 10^{-2}$ mm.

2. A razor according to claim 1, in which the filaments are of nylon, acetate or acrylic filaments.

3. A safety razor having a skin engaging surface, wherein said surface is composed of an array of projections, said projection extending throughout their lengths away from said surface, said projections comprising a plurality of rows extending generally parallel with the blade edge(s), the said projection begin flexible under normal shaving forces in directions transverse to the blade edge(s), and wherein said projections have a height up to 2.5 mm, a ratio of height to base thickness in the range of 2:1 to 5:1 and a spacing between adjacent longitudinal rows of 0.3 to 1.5 mm.

4. A razor in accordance with claim 3, wherein the projections are formed as upstanding walls, each tapering to a very thin edge.

5. A razor in accordance with claim 4, wherein the surface is composed of a grid of mutually transverse rows of walls forming rectangular open cells, the walls parallel with the blade edge(s) constituting the said projections.

6. A razor in accordance with claim 4, wherein the walls are spaced apart in respective, mutually transverse rows to form rectangular cells open at their corners.

7. A razor according to claim 6, wherein the walls are formed integrally with a base having apertures at the intersection of each group of four adjacent walls.

8. A razor according to claim 4, in which the projections are formed as longitudinal fins.

9. A razor according to claim 8, wherein the said fins slope upwardly and forwardly or rearwardly from their bases at an acute angle to the shaving direction.

10. A razor according to claim 8, wherein the said fins are interrupted at intervals along their lengths.

11. A razor according to claim 3, wherein the projections are constituted by a plurality of individual upstanding pillars arranged in a plurality of parallel rows with a spacing between pillars in each row, and between adjacent longitudinal arrows, in the range of 0.6 to 1.5 mm.

12. A razor according to claim 11, where the pillars are of a synthetic elastomeric material.

13. A razor according to claim 11, wherein the pillars are individually set in a base of synthetic elastomeric material which permits deflection of the pillars about their lower ends, the pillars being of a more rigid material than the base.

* * * * *

UNITED STATES PATENT AND TRADEMARK OFFICE

CERTIFICATE OF CORRECTION

PATENT NO. : 5,191,712

DATED : March 9, 1993

INVENTOR(S) : Alan Crook, et al

It is certified that error appears in the above-indentified patent and that said Letters Patent is hereby corrected as shown below:

The drawing sheets, consisting of Figs. 2-8, should be deleted to be replaced with the drawing sheets, consisting of Figs. 2-8, as shown on the attached page.

Signed and Sealed this

Twelfth Day of April, 1994

Bruce Lehman

*Attest:*

BRUCE LEHMAN

*Commissioner of Patents and Trademarks*

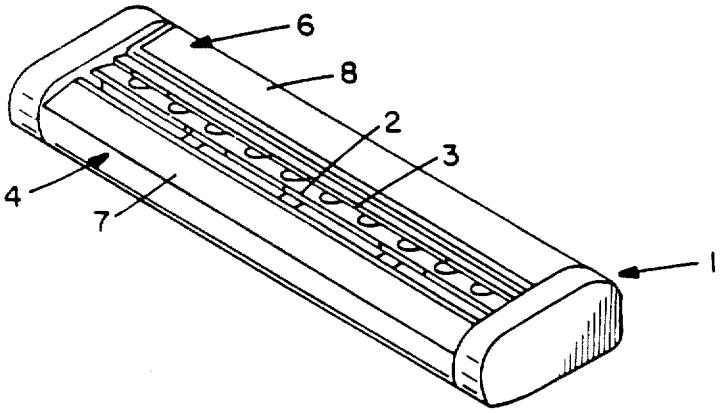
FIG. 1
FIG. 8
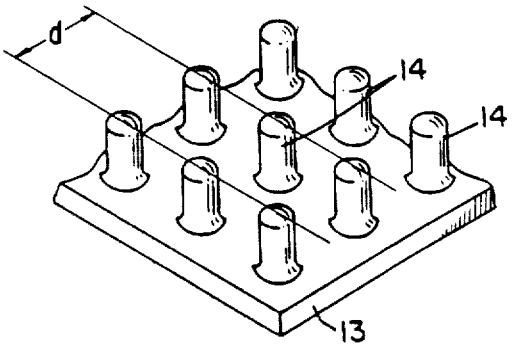

*Attesting Officer*